US008668456B2

(12) United States Patent
Merriman et al.

(10) Patent No.: US 8,668,456 B2
(45) Date of Patent: Mar. 11, 2014

(54) BLADE

(75) Inventors: Nicholas M. Merriman, Derby (GB); Simon Read, Derby (GB)

(73) Assignee: Rolls-Royce PLC, London (GB)

( * ) Notice: Subject to any disclaimer, the term of this patent is extended or adjusted under 35 U.S.C. 154(b) by 377 days.

(21) Appl. No.: 13/267,375

(22) Filed: Oct. 6, 2011

(65) Prior Publication Data

US 2012/0100006 A1 Apr. 26, 2012

(30) Foreign Application Priority Data

Oct. 22, 2010 (GB) ..... 1017832.5

(51) Int. Cl.

| | |
|---|---|
| ***F01D 5/14*** | (2006.01) |
| ***F01D 5/28*** | (2006.01) |
| ***F04D 29/32*** | (2006.01) |
| ***F04D 29/38*** | (2006.01) |
| *F01D 5/16* | (2006.01) |

(52) U.S. Cl.

CPC . *F01D 5/147* (2013.01); *F01D 5/16* (2013.01); *F01D 5/282* (2013.01); *F04D 29/324* (2013.01); *F04D 29/38* (2013.01); *Y10S 416/50* (2013.01)

USPC ..... 416/132 A; 416/132 B; 416/224; 416/229 R; 416/232; 416/500

(58) Field of Classification Search

CPC ..... F01D 5/147; F01D 5/16; F01D 5/282; F04D 29/324; F04D 29/38

USPC ..... 416/2, 132 A, 132 B, 224, 229 R, 230, 416/229 A, 232, 231 R, 241 A, 500

See application file for complete search history.

(56) References Cited

U.S. PATENT DOCUMENTS

| | | | | |
|---|---|---|---|---|
| 3,822,103 | A * | 7/1974 | Hori et al. | 416/132 R |
| 4,006,999 | A | 2/1977 | Brantley et al. | |
| 7,083,377 | B2 * | 8/2006 | Wobben | 415/1 |
| 2009/0175723 | A1 * | 7/2009 | Broome | 416/1 |

FOREIGN PATENT DOCUMENTS

| | | |
|---|---|---|
| EP | 1 908 919 A1 | 4/2008 |
| GB | 2 450 139 A | 12/2008 |

OTHER PUBLICATIONS

Feb. 22, 2011 British Search Report issued in GB1017832.5.

* cited by examiner

*Primary Examiner* — Igor Kershteyn
(74) *Attorney, Agent, or Firm* — Oliff PLC

(57) ABSTRACT

A turbomachine blade having features arranged to initiate bending of the leading edge towards the pressure surface upon impact of a foreign object on the leading edge. The features may be features weaker than the material of the leading edge located on the pressure surface side of a mid-thickness line. By causing the leading edge to bend towards the pressure surface on impact the volume of the foreign object, typically a bird, that passes over the suction surface is reduced.

10 Claims, 2 Drawing Sheets

BLADE

This invention relates to turbomachine blades and particularly to turbomachine fan blades which may be used in an aero engine.

Occasionally turbomachine fan blades may be impacted during operation by foreign objects such as birds. It is an object of the present invention to seek to provide an improved turbomachinery blade with greater resistance to damage from foreign object impact.

According to a first aspect of the invention there is provided a turbomachine blade having a leading edge, a trailing edge, a concave pressure surface and a convex suction surface; wherein the leading edge is provided with a deflection initiator which initiates deflection of the leading edge towards the pressure surface upon impact of a foreign body against the leading edge of the blade.

The blade may have a composite core and a metallic leading edge joined to the composite core. The blade may be wholly metallic or a hybrid combining metallic spars with polymeric or plastic inserts. The blade may be hollow.

The deflection initiator may comprise one or more features with a stiffness less than that of the material of the leading edge, the or each feature being located at least partly on the pressure surface side of a mean camber line taken through the blade between the leading edge and the trailing edge and equispaced from both the pressure and suction surfaces. The or each feature may be located in their entirety on the pressure surface side of the mean camber line.

Preferably the blade has a chord extending from the tip of the leading edge to the tip of the trailing edge and the feature extends no more rearward than ⅓ of the chordal length measured from the tip of the leading edge.

The feature preferably has a chordal length measured from the start of the feature to the end of the feature that is greater than or equal to a chordal length measured from the tip of the leading edge to the start of the feature.

The feature may be separated from the pressure surface by a web of material which is connected to a portion of the leading edge chordally forwards of the feature and which is deflectable into the feature to pull the tip of the tip of the leading edge towards the pressure surface. The web of material is preferably of the same material as the leading edge. An inner surface of the web may provide a wall of the feature and the outer surface of the web provides at least a portion of the pressure surface.

Preferably the features are one or more cavities. The cavities may be filled with a flexible material such as a viscoelastic material, polymer or foam. The cavities may be hollow.

The features may extend the whole radial length of the blade from a blade root to the blade tip or along only a portion thereof. A series of partial bade length features may be used.

The features may have square, round, polygonal (regular or otherwise) cross-section.

The leading edge may be formed by a solid free form fabrication technique with the features being formed during formation of the leading edge. Alternatively or additionally, material may be removed by chemical or mechanical means to form or tailor the features following manufacture of the leading edge.

Embodiments of the invention will now be described by way of example only, with reference to the accompanying drawings, in which.

Figure 1:
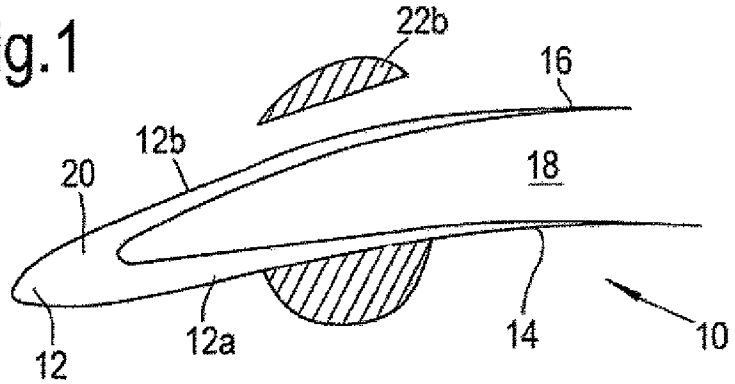
FIG. 1 depicts foreign object impact on the leading edge of a conventional fan blade.

FIG. 1 depicts a cross section through the leading portion of a conventional fan blade 10. The blade has an exterior profile having a leading edge 12, a trailing edge (not shown) and a pressure surface 14 and a suction surface 16 connecting between the leading and trailing edges. The pressure surface has a generally concave in profile; the suction surface has a generally convex profile. During operation the blade rotates about the axis of the engine in which it is located in a direction in which the suction surface follows the pressure surface.

The blade of FIG. 1 is a composite blade having a composite core 18 with a metallic leading edge 20. The metallic leading edge provides reinforcement to the composite and more robust to impact from foreign bodies than the composite. The metallic leading edge has a fore portion and wings 12*a*, 12*b* which extend at least part-way along the pressure and suction surfaces respectively.

The leading edge extends up to a third of the chordal length of the blade extending between the tip of the leading edge and the tip of the trailing edge.

The blade may be impacted by a foreign object, such as a bird, in use. Whilst no two impacts are the same the blade velocity and bird speed mean that the bird is chopped by the blade into portions some of which travel along the pressure surface and some of which pass by the suction surface. The bird impact may be spread across several adjacent blades with each blade dividing the bird. The metallic leading edge protects the composite core and prevents or limits damage to it.

Any portion of the bird 22*a* that passes along the concave pressure surface typically remains attached to the surface along the whole chordal width of the blade between the leading and trailing edges which can create significant damage to the pressure surface which is required to react and deflect the force of the bird.

Any portion of the bird 22*b* that passes along the convex suction surface of the blade typically will detach from the blade and pass through the blade passage (the circumferential space between adjacent blades) without further impact or damage to the fan blades.

Figure 2:
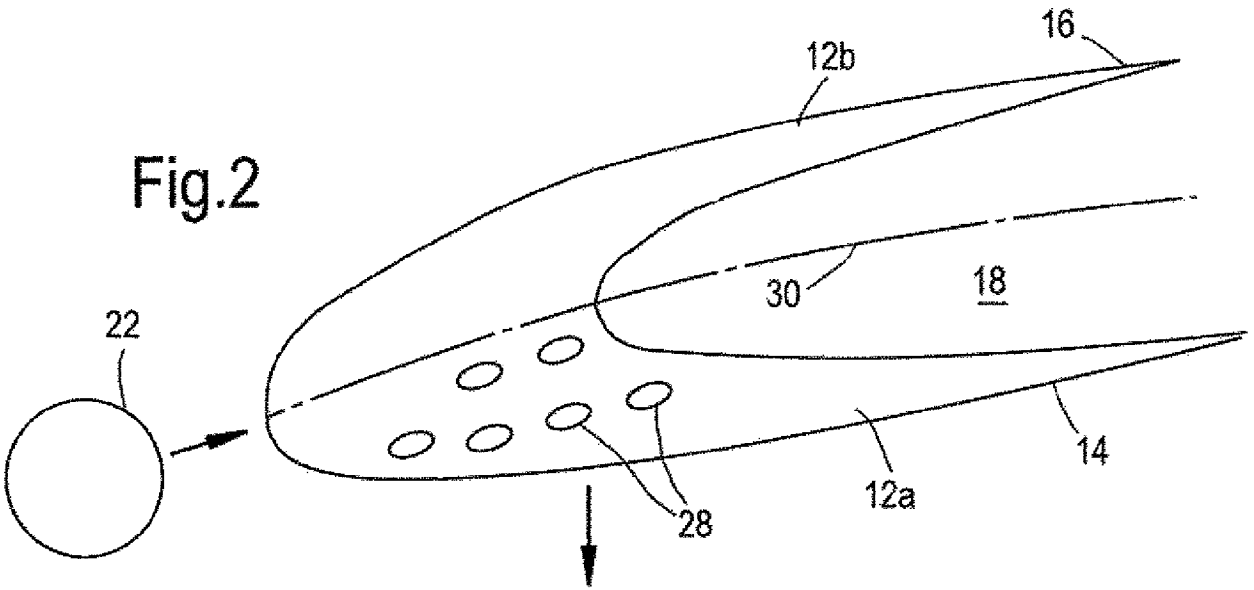
FIG. 2 depicts a leading portion of a fan blade in accordance with one embodiment of the invention.

FIG. 2 depicts an embodiment of the invention having a metallic leading edge 20 and a composite core 18. The metallic leading edge is provided with a deflection initiator which, in this embodiment, comprises one or more features that are weaker than the metal from which the leading edge is formed. The deflection initiator is located within the metallic leading edge and initiates deflection of the leading edge towards the pressure surface upon impact of a foreign body to the aerofoil. The distance of a third of the chordal length is the preferred maximum distance from the leading edge tip for the most chordally rearward edge of the initiator. This maximum distance is the same whether the blade is composite with a metallic leading edge or fully metallic.

In the embodiment shown the weakened features are cavities which may be cylindrical or any other appropriate shape, e.g. square, rectangular, triangular, arrowhead etc. provided that the preferential buckling of the leading edge towards the pressure surface is achieved on impact. The cavities shown are hollow but may be filled with a non-structural viscoelastic material which can help dampen the vibration characteristics of the blade and improve the high cycle fatigue strength of the blade.

Figure 3:
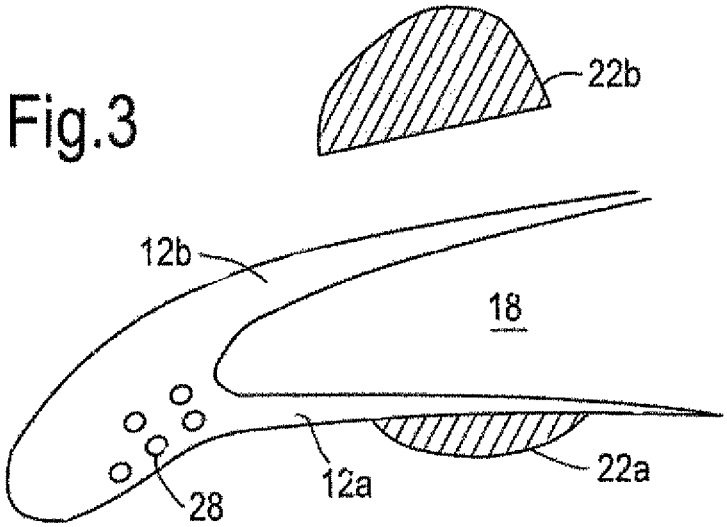
FIG. 3 depicts the effect of foreign object impact to the fan blade of FIG. 2.

On impact of a foreign object to the leading edge the leading edge deflects towards the pressure surface as shown in FIG. 3 caused primarily by the collapse of the weakened features. This has the effect of changing the way the blade interacts with the foreign object to deflect a greater proportion of the matter over the suction surface rather than over the pressure surface. As discussed earlier the matter passing over the suction surface generates significantly less damage to the aerofoil than foreign matter passing over the pressure surface. By reducing the mass of the foreign object passing over the pressure surface the strength requirement of the pressure surface is reduced and enables the use of thinner, but less strong, blades which are more efficient than conventional blades and which enable reduction in engine fuel burn.

The weakened features making up the deflection initiator are in practice located on the pressure surface side of the mean camber line taken through the blade between the leading edge and the trailing edge and equispaced from both the pressure and suction surfaces.

Figure 4:
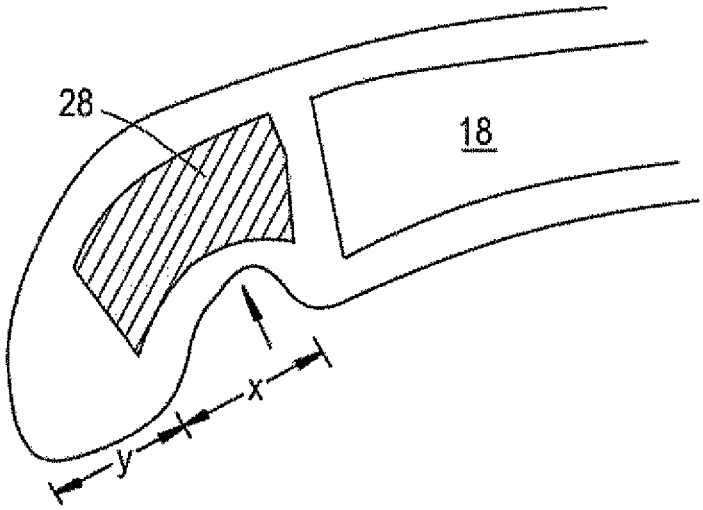
FIG. 4 depicts a leading portion of a fan blade showing deformation of the web into the deflection intiator.

As shown in FIG. 4 the deflection of the leading edge towards the pressure surface is effected by movement of a web of material into the deflection initiator. As the foreign object initially begins to move along the leading edge it exerts a pressure which causes the web to buckle. The web is connected to or continuous with the leading edge portion chordally forwards of the forward edge of the deflection initiator. The buckling or deformation pulls the portion towards the pressure surface before a significant volume of the foreign object has passed the leading edge tip thereby increasing the volume which passes over the suction surface.

The web of material may be the same material as that of the leading edge and the outer surface thereof may provide the pressure surface. It should be of sufficient strength not to be deformed during normal operation of the aerofoil.

It has been found that best results are achieved where the blade has a chord extending from the tip of the leading edge to the tip of the trailing edge and the feature extends no more rearward than ⅓ of the chordal length measured from the tip of the leading edge and where the feature has a chordal length (x) measured from the start of the feature to the end of the feature that is greater than or equal to a chordal length (y) measured from the tip of the leading edge to the start of the feature.

The invention claimed is:

1. A turbomachine blade having a leading edge, a trailing edge, a concave pressure surface and a convex suction surface; wherein the leading edge is provided with a deflection initiator which initiates deflection of the leading edge towards the pressure surface upon impact of a foreign body against the leading edge of the blade.

2. A blade according to claim 1 having a composite core and a metallic leading edge joined to the composite core.

3. A blade according to claim 1, wherein the deflection initiator comprises one or more features with a stiffness less than that of the material of the leading edge, the features being located at least partly on the pressure surface side of a mean camber line taken through the blade between the leading edge and the trailing edge and equispaced from both the pressure and suction surfaces.

4. A blade according to claim 3, wherein the features are one or more cavities.

5. A blade according to claim 3, wherein the features are located in their entirety on the pressure surface side of the mean camber line.

6. A blade according to claim 3, wherein the blade has a chord extending from the tip of the leading edge to the tip of the trailing edge and the feature extends no more rearward than ⅓ of the chordal length measured from the tip of the leading edge.

7. A blade according to claim 6, wherein the feature has a chordal length measured from the start of the feature to the end of the feature that is greater than or equal to a chordal length measured from the tip of the leading edge to the start of the feature.

8. A blade according to claim 6, wherein the feature is separated from the pressure surface by a web of material which is connected to a portion of the leading edge chordally forwards of the feature and which is deflectable into the feature to pull the tip of the tip of the leading edge towards the pressure surface.

9. A blade according to claim 8, wherein the web of material is of the same material as the leading edge.

10. A blade according to claim 8, wherein a inner surface of the web provides a wall of the feature and the outer surface of the web provides at least a portion of the pressure surface.

* * * * *